United States Patent [19]

Brown

[11] Patent Number: 4,949,644

[45] Date of Patent: Aug. 21, 1990

[54] NON-TOXIC SHOT AND SHOT SHELL CONTAINING SAME

[76] Inventor: John E. Brown, 8 Northwood Drive, St. Catherines, Ontario, Canada, L2M 4J6

[21] Appl. No.: 370,788

[22] Filed: Jun. 23, 1989

[51] Int. Cl.[5] ..... F42G 5/24

[52] U.S. Cl. ..... 102/498; 102/501

[58] Field of Search ..... 102/448, 501

[56] References Cited

U.S. PATENT DOCUMENTS

| | | | |
|---|---|---|---|
| 204,298 | 3/1878 | Crooke . | |
| 2,095,302 | 10/1936 | Woodford et al. . | |
| 2,966,427 | 12/1960 | Breining . | |
| 3,045,334 | 7/1962 | Berzins . | |
| 3,065,535 | 11/1962 | Crehan et al. . | |
| 3,198,877 | 11/1965 | Olson et al. . | |
| 3,481,796 | 12/1969 | Brown . | |
| 3,880,081 | 4/1975 | Riffin et al. . | |
| 3,897,732 | 11/1975 | Atkins et al. . | |
| 4,005,660 | 2/1977 | Pichard | 102/501 |
| 4,236,922 | 12/1980 | Michl et al. . | |
| 4,381,692 | 5/1983 | Weintraub . | |
| 4,383,853 | 5/1983 | Zapffe . | |
| 4,397,812 | 11/1983 | Mallory, Jr. . | |
| 4,428,295 | 1/1984 | Urs . | |
| 4,454,175 | 6/1984 | Martin . | |
| 4,655,832 | 4/1987 | Omori et al. . | |
| 4,686,904 | 11/1987 | Stafford . | |
| 4,714,023 | 12/1987 | Brown . | |
| 4,729,321 | 3/1988 | Stafford . | |

*Primary Examiner*—Stephen J. Lechert, Jr.

*Attorney, Agent, or Firm*—Bernard, Rothwell & Brown

[57] ABSTRACT

Non-toxic wildlife shot pellets for shotgun shells are formed from bismuth or a bismuth alloy.

19 Claims, 1 Drawing Sheet

NON-TOXIC SHOT AND SHOT SHELL CONTAINING SAME

BACKGROUND OF THE INVENTION

1. Field of the Invention

The present invention relates to improved wildlife shot pellets and shot shells containing same.

2. Description of the Background Art

Lead shot conventionally is employed in shotguns. The density of lead provides shot made therefrom with a ballistic efficiency which heretofore has not been matched by any other commercially available shot material, such as steel. Unfortunately, lead presents a serious toxicity problem to waterfowl. Spent shot lying on the bottom of shallow lakes and marshes within reach of feeding ducks and geese is sometimes ingested along with similar sized gravel and taken into the gizzard of the bird. After being broken down in the gizzard, the lead is absorbed into the bird's system, often in lethal doses. Studies have shown that the number of waterfowl which die from lead poisoning have been significant. As a result, steps have been taken in some areas of the United States to ban the use of lead shot in favor of non-toxic shot such as steel shot for hunting wildfowl.

There have been a number of proposals for alleviating this problem. One approach which has been taken is to coat shot in an attempt to isolate the lead from the wildfowl digestive system, but most metallic and non-metallic coatings have been unsuccessful to date. For example, tin, copper and magnesium coatings are quickly ground off by the abrasive action of the bird's gizzard. Nylon and many similar plastics have a melting point so near to that of lead that coating is impractical. Successfully applied plastic coatings have been found to resist the abrasive action of the gizzard no better than the above-noted metals and, indeed, in the instance of one epoxy resin, hastened the death of ducks. Other forms of coating include nickel coating applied to the lead shot. Such nickel coating has been applied by electrodeposition techniques to a thickness in the range of 0.001 to 0.003 of an inch. However, in tests, inadequate results have been realized due primarily to the fact that the nickel coating, as provided by electrodeposition, is of insufficient hardness. Hence, the nickel coating is ground off in the digestive system of the wildfowl, thereby exposing the lead and causing lead poisoning.

One coating which has proven effective is disclosed in my prior U.S. Pat. No. 4,714,023, wherein lead shot pellets are uniformly coated with a nickel-phosphorous alloy having a Rockwell hardness of at least 45. Despite the effectiveness of this particular coating, the fact that the pellets do contain lead has limited their commercial success.

Iron and steel shot are non-toxic but are ballistically inferior to lead and damage shotgun barrels. Steel shot occupies a much greater volume than the same weight of lead shot and fitting a sufficient number of steel shot to provide adequate shot pattern into existing shell cases is a major difficulty. Solid copper shot is ballistically more efficient than iron and does little damage to gun barrels, but is almost as toxic as lead.

There remains a need in the art for a completely lead-free shot that is ballistically similar to lead shot.

SUMMARY OF THE INVENTION

In accordance with one aspect of the present invention, a projectile is provided which comprises a non-toxic wildlife shot pellet for a shotgun shell, the pellet being primarily made up of bismuth.

In accordance with another aspect of the invention, improved shot is provided for use in a shell, the shot comprising a plurality of substantially spherical pellets which are primarily made up of bismuth, the plurality of pellets being of substantially uniform size within a range selected from the group consisting of BBB to "dust" shot size, and OOO to T size.

In accordance with still another aspect of the invention, a shell is provided comprising a casing, a propellant contained within the casing, means for igniting the propellant, and non-toxic wildlife shot formed of a plurality of pellets containing bismuth.

DETAILED DESCRIPTION OF THE INVENTION

Figure 1:
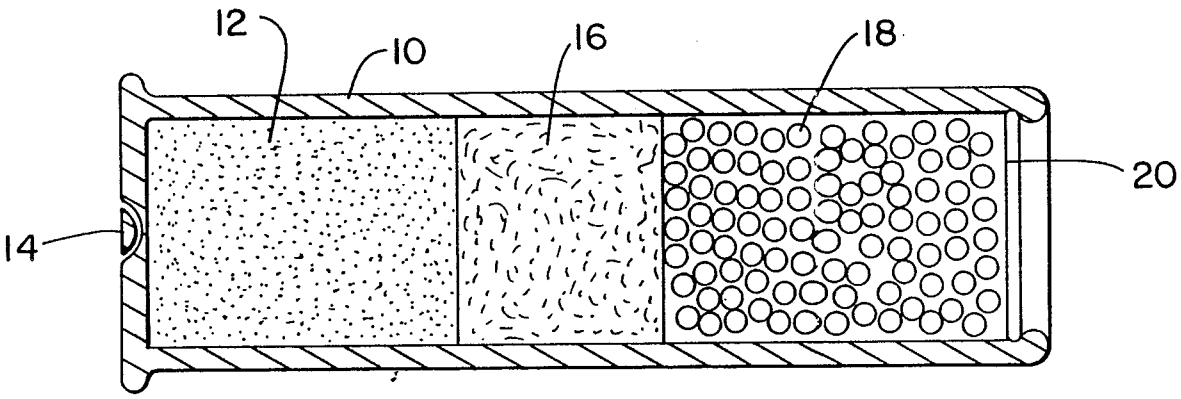
FIG. 1 is a partly schematic cross-sectional view of a shotgun shell including a load of non-toxic wildlife shot pellets containing bismuth according to the present invention.

FIG. 1 illustrates a shotgun shell including a casing 10 which, for illustrative purposes, is shown to be of uniform material whereas in actual practice, the casing typically has a metal portion at the base with a body formed of paper or plastic. Within casing 10 is an explosive propellant in the form of powder 12. The propellant 12 is ignited by means of a primer 14 which is actuated when struck by a firing pin (not shown).

In the embodiment shown, a wadding 16 is positioned adjacent the propellant 12, which wadding can be made up of jute, felt, or plastic cushioning and obturative material. Adjacent the wadding 16 are nontoxic pellets 18 of the present invention, with the end of the shell being closed at 20 to retain the pellets therein until the shell is fired. This closure can be accomplished by a light disk made of cardboard or other material, or the casing can be folded to close the end so that when the shell is fired, the end merely unfolds without any end cap or other closure member preceding the pellets out of the shotgun barrel.

Applicant has discovered that bismuth is an excellent material for use in forming non-toxic shot pellets 18. The bismuth-containing pellets of the present invention can be any useful size, for example, BBB to "dust" size (BBB, BB, B, 1–7, 7½, 8–12, and "dust" size) or OOO-T (OOO, OO, O, 1–4, FF, F, TT, and T).

Pellets in accordance with the present invention are formed by casting, spin molding, dropping, punching, or in any other suitable manner.

Typically, shotgun shells are manufactured in gauges 410, 20, 16, 12 or 10, and contain a load of shot weighing within the range of from about ½ ounce to about 2½ ounces, dependent upon the gauge. Accordingly, one aspect of the invention is directed to a load of non-toxic, bismuth-containing shot weighing from about ½ ounce to about 2½ ounces.

According to one aspect of the present invention, non-toxic shot is made from substantially pure bismuth. It has also been discovered that bismuth provides an excellent alloy component when combined with other non-toxic metals for forming non-toxic shot pellets. For example, the density of a mixture of 50% by weight bismuth and 50% of another metal such as zinc, tin, antimony or the like, or mixtures thereof, has a density closer to lead than to iron. Accordingly, in preferred embodiments, pellets in accordance with the present invention contain at least about 50% bismuth by weight. In more preferred embodiments, the pellets contain at least about 60%, 70%, 80%, 90%, or 95% by weight bismuth. Pellets formed from alloy containing the 60–95% by weight or more bismuth perform ballistically substantially better than iron or steel, and with increasingly high proportions of bismuth, such pellets approach or attain the ballistic performance of corresponding lead pellets.

In particularly preferred embodiments, the pellets contain about 98% by weight or more bismuth. For example, an alloy containing about 98% by weight bismuth and about 2% by weight tin or antimony can be formed into non-toxic pellets which perform ballistically substantially the same as lead.

In other particularly preferred embodiments, pellets in accordance with the present invention contain about 99% by weight or more bismuth. For example, an alloy of about 99% by weight bismuth and about 1% by weight zinc has about the same density as lead and performs substantially the same ballistically as lead.

The invention is further illustrated by the following example, which is not intended to be limiting.

EXAMPLE

An alloy was formed containing 99.9% by weight bismuth and 0.1% by weight tin. The alloy was melted and cast into pellets using an aluminum mold. The pellets were slightly harder than pure lead and heavier than lead. Loads were put together using heavier than normal powder charge and without buffering or the use of shot sleeves, in order to test the pellets under harsher than normal conditions. In testing, the shot produced good patterns, and recovered pellets showed substantially the same deformation characteristics as lead.

The present invention provides non-toxic wildlife shot which performs ballistically superior to soft iron or steel shot. In fact, pellets according to the present invention can perform ballistically substantially the same as corresponding lead shot. Furthermore, the non-toxic wildlife shot containing bismuth in accordance with the present invention has deformation characteristics similar to lead. This provides shot in accordance with the present invention with similar animal stopping characteristics as lead, which is considerably better than the stopping characteristics of soft iron or steel shot, which does not deform. This is of particular significance since there are some indications that the kill ratios may be about the same for birds which die of lead poisoning due to ingestion of lead pellets, and birds which are wounded by steel shot, yet escape and later die from their wounds.

Since many modifications, variations and changes in detail may be made to the described embodiments, it is intended that all matter in the foregoing description and shown in the accompanying drawing be interpreted as illustrative and not in a limiting sense.

I claim:

1. A projectile comprising a substantially spherical, non-toxic wildlife shot pellet for a shotgun shell, said pellet being all-metal and primarily made up of bismuth, said pellet being of a size within a range selected from the group consisting of BBB to "dust" shot size, and OOO to T size.

2. The projectile of claim 1 wherein said pellet is formed of an alloy having substantially the same ballistics as lead.

3. The projectile of claim 1, further comprising tin, antimony, zinc or a mixture thereof.

4. An improved shot comprising a plurality of substantially spherical, all-metal, non-toxic wildlife shot pellets which contain a substantial amount of bismuth, said plurality of pellets being of substantially uniform size within a range selected from the group consisting of BBB to "dust" shot size, and OOO to T size.

5. The shot of claim 4 wherein said pellets contain at least about 50% by weight or more bismuth.

6. The shot of claim 4 wherein said pellets contain at least about 60% by weight or more bismuth.

7. The shot of claim 4 wherein said pellets contain at least about 70% by weight or more bismuth.

8. The shot of claim 4 wherein said pellets contain at least about 80% by weight or more bismuth.

9. The shot of claim 4 wherein said pellets contain at least about 90% by weight or more bismuth.

10. The shot of claim 4 wherein said pellets contain at least about 95% by weight or more bismuth.

11. The shot of claim 4 wherein said pellets contain at least about 98% by weight or more bismuth.

12. The shot of claim 4 wherein said pellets contain at least about 99% by weight or more bismuth.

13. The shot of claim 4 wherein said pellets have substantially the same ballistics as corresponding lead pellets.

14. The shot of claim 4 wherein said pellets further comprise tin, antimony, zinc or mixtures thereof.

15. A load of shot as defined in claim 4 having a weight within the range of from about $\frac{1}{4}$ ounce to about $2\frac{1}{2}$ ounces.

16. A shell comprising:

(a) a casing;

(b) a propellant contained within said casing;

(c) means for igniting said propellant; and (d) all-metal non-toxic wildlife shot formed of a plurality of pellets containing a substantial amount of bismuth.

17. The shell of claim 16 wherein said pellets are primarily made up of bismuth.

18. The shell of claim 16 wherein said pellets have substantially the same ballistics as corresponding lead pellets.

19. The projectile of claim 1 wherein said pellet is formed by casting, spin molding, dropping or punching.

* * * * *